US009865918B2

(12) United States Patent
Harleman

(10) Patent No.: US 9,865,918 B2
(45) Date of Patent: Jan. 9, 2018

(54) SLIDING RADOME WITH SUPPORT STRUCTURE

(71) Applicant: The Boeing Company, Chicago, IL (US)

(72) Inventor: Thomas J. Harleman, Maple Valley, WA (US)

(73) Assignee: THE BOEING COMPANY, Chicago, IL (US)

( * ) Notice: Subject to any disclaimer, the term of this patent is extended or adjusted under 35 U.S.C. 154(b) by 201 days.

(21) Appl. No.: 14/838,964

(22) Filed: Aug. 28, 2015

(65) Prior Publication Data

US 2017/0062920 A1 Mar. 2, 2017

(51) Int. Cl.
*H01Q 1/28* (2006.01)
*H01Q 1/42* (2006.01)

(52) U.S. Cl.
CPC ..... *H01Q 1/428* (2013.01); *H01Q 1/28* (2013.01)

(58) Field of Classification Search
None
See application file for complete search history.

(56) References Cited

U.S. PATENT DOCUMENTS 3,656,164 A * 4/1972 Rempt ..... H01Q 1/428 343/705
4,346,386 A * 8/1982 Francis ..... H01Q 3/02 343/705
4,509,709 A * 4/1985 Utton ..... B64C 1/36 244/118.1
5,969,686 A * 10/1999 Mackenzie ..... H01Q 1/42 343/705
8,844,866 B2 * 9/2014 De Azevedo ..... B64C 1/36 244/118.5
2001/0014278 A1 * 8/2001 Maffeis ..... F15B 15/1404 414/749.1
2006/0202088 A1 * 9/2006 Padan ..... B64D 1/00 244/137.1
2014/0163456 A1 * 6/2014 Kiss ..... A61M 37/00 604/24
2015/0101478 A1 * 4/2015 Palmer ..... H01Q 15/14 89/1.82
2015/0298807 A1 * 10/2015 Chun ..... B64C 7/00 244/137.4

* cited by examiner

*Primary Examiner* — Trinh Dinh
(74) *Attorney, Agent, or Firm* — MH2 Technology Law Group LLP

(57) ABSTRACT

A radome includes a shell defining an internal volume. A track is coupled to the shell, and the track allows the shell to move axially between an open position and a closed position. A support structure is coupled to the shell, and the support structure moves from a collapsed position to an expanded position.

18 Claims, 6 Drawing Sheets

SLIDING RADOME WITH SUPPORT STRUCTURE

TECHNICAL FIELD

The present teachings relate to the field of aircraft radar systems and, more particularly, to a radome that covers a radar system on an aircraft.

BACKGROUND

A radar system uses radio waves to determine the range, altitude, direction, and/or speed of objects. The radar system may be positioned underneath the body of an aircraft (e.g., airplane) to analyze objects positioned beneath the aircraft as the aircraft is flying. When in use, the radar system is covered by a radome, which is a structural, weatherproof enclosure that protects the radar system. The radome is constructed of a material that is substantially transparent to radio waves so that the radome minimally attenuates the radio waves transmitted or received by an antenna of the radar system.

The radome is opened to provide access for a user to perform maintenance on the radar system. There are at least three types of radomes, each of which may be opened differently. The first type of radome is a single structure that is hinged on one side of the body of the aircraft and rotates about the hinge(s) to the open position. However, when the clearance between the ground and the radome is less than a predetermined amount, the radome may contact the ground during the rotation. The second type of radome is a two-piece "clam shell" structure that opens by rotating the halves of the clam shell along opposing hinge lines to provide access to the radar system from underneath. The clam shell may have a beam at the center where the two clam shells meet for structural support. This beam moves the radar system closer to the body of the aircraft, which can cause additional blockage due to, for example, engines located below a wing. Additionally, the functioning of the radar system may be impaired when looking through the beam. The third type of radome is a single structure that is coupled to the body of the aircraft at its periphery with a plurality of coupling devices. This type of radome often requires external ground support equipment to support the radome during removal to gain access to the radar system.

SUMMARY

The following presents a simplified summary in order to provide a basic understanding of some aspects of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A radome is disclosed that includes a shell defining an internal volume. A track is coupled to the shell, and the track allows the shell to move axially between an open position and a closed position. A support structure is coupled to the shell, and the support structure moves from a collapsed position to an expanded position.

In another embodiment, the radome includes a shell defining an internal volume. A track is coupled to the shell. The track of the shell is configured to be coupled to a corresponding track of a body, and the track of the shell is configured to move axially with respect to the track of the body, thereby allowing the shell to move axially with respect to the body between an open position and a closed position. A support structure is coupled to the shell. The support structure is configured to move from a collapsed position to an expanded position. The support structure is coupled to the track of the shell such that the support structure is configured to move axially with respect to the shell.

A method for accessing a radar system that is coupled to a bottom side of a body of an aircraft is disclosed. The method includes moving a shell axially toward an aft of the body from a closed position to an open position. The shell covers the radar system when in the closed position, and the shell allows access to the radar system when in the open position. A support structure that is coupled to the shell is moved from a collapsed position to an expanded position. The support structure is coupled to the body when the support structure is in the expanded position.

The features, functions, and advantages that have been discussed can be achieved independently in various implementations or may be combined in yet other implementations further details of which can be seen with reference to the following description and drawings.

BRIEF DESCRIPTION OF THE DRAWINGS

The accompanying drawings, which are incorporated in and constitute a part of this specification, illustrate the present teachings and together with the description, serve to explain the principles of the disclosure. In the figures.

It should be noted that some details of the Figures have been simplified and are drawn to facilitate understanding of the present teachings rather than to maintain strict structural accuracy, detail, and scale.

DETAILED DESCRIPTION

Reference will now be made in detail to examples of the present teachings which are illustrated in the accompanying drawings. Wherever possible, the same reference numbers will be used throughout the drawings to refer to the same or like parts.

Figure 1:
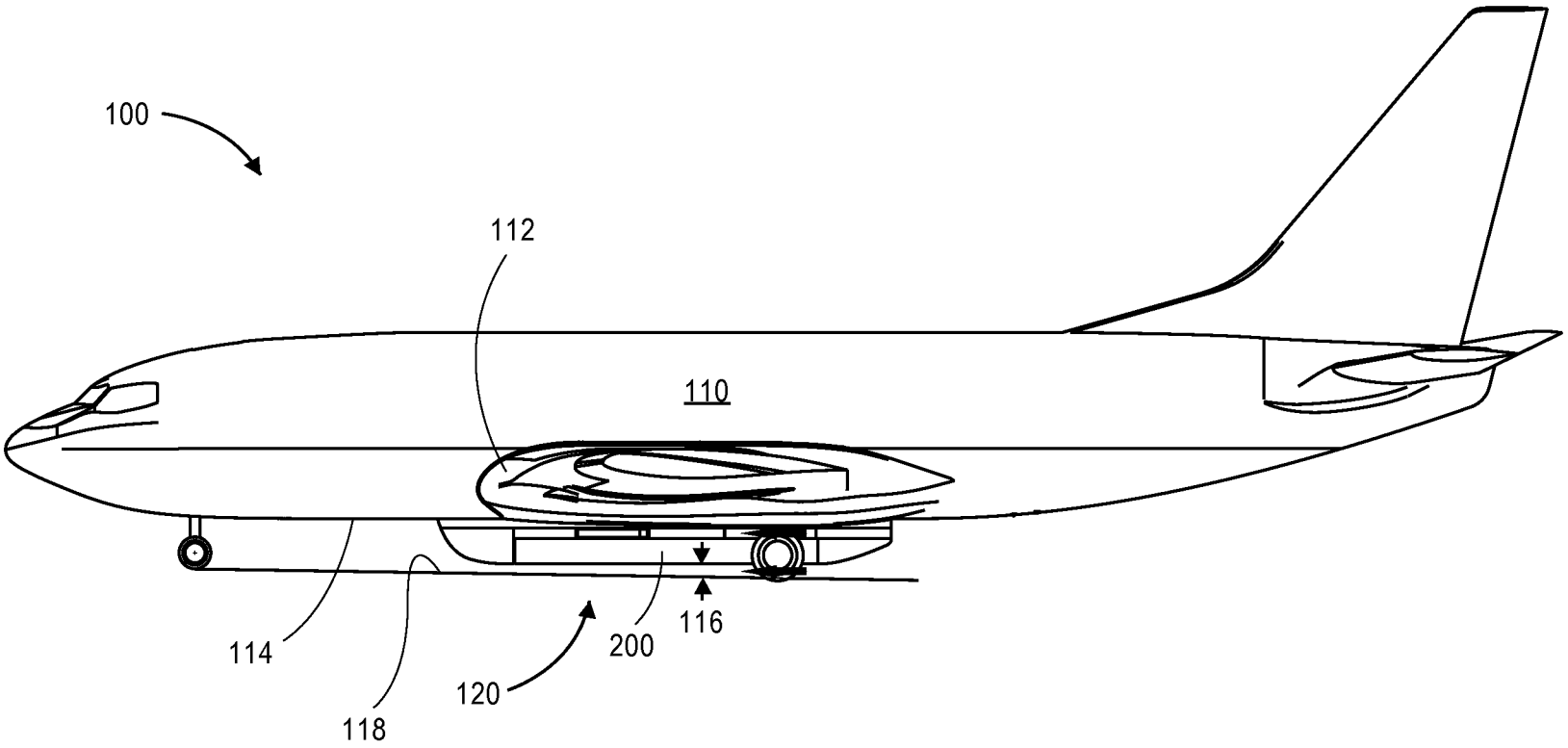
FIG. 1 is a side view of an aircraft having a radar system coupled thereto and a radome covering the radar system.

FIG. 1 is a side view of an aircraft 100 having a radar system 120 coupled thereto and a radome 200 covering the radar system 120. The aircraft 100 may be an airplane (as shown), a helicopter, an unmanned aircraft (e.g., a drone), or the like. The aircraft 100 may include a body 110 having wings 112 extending laterally therefrom. One or more engines may be coupled to each wing 112 to propel the aircraft 100 forward. The engines have been omitted from FIG. 1 to provide a line of sight to the radar system 120 and the radome 200.

The radar system 120 may be coupled to a lower or bottom side 114 of the aircraft 100. The radar system 120 may include one or more antennas that is/are configured to transmit and receive radio waves in order to determine the range, altitude, direction, and/or speed of objects below the aircraft 100 as the aircraft 100 is flying.

The radome 200 is shown in a first, closed position in FIG. 1. In the closed position, the radome 200 covers the radar system 120 to protect the radar system 120 from damage due to weather, debris, etc. A distance 116 between the radar system 120 and the ground 118 and/or between the radome 200 and the ground 118 may be from about 5 cm to about 50 cm, from about 5 cm to about 20 cm, or from about 5 cm to about 10 cm. As such, at least a portion of the radar system 120 and at least a portion of the radome 200 may be positioned below (i.e., closer to the ground 118 than) a lowermost point on the engine(s). This may allow the radar system 120 to transmit and receive radio waves in a generally downward direction without (or with minimal) interference from the engine(s).

Figure 2:
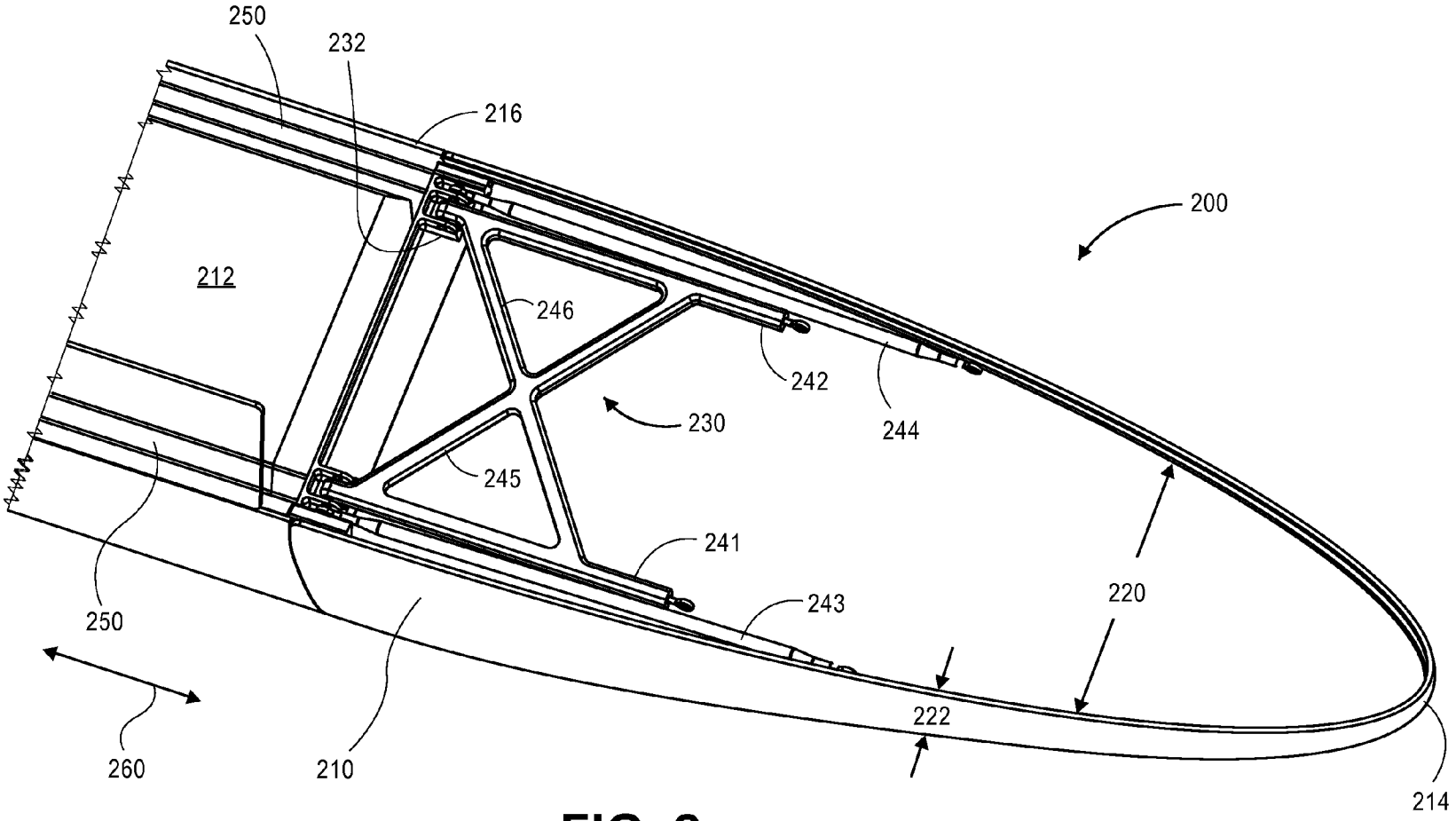
FIG. 2 is a top view of a portion of the radome.

FIG. 2 is a top view of a portion of the radome 200. The radome 200 may include a shell 210 that defines an internal volume 212. As shown, at least a portion of the shell 210 may be in the shape of a "canoe." Thus, a width 220 of the shell 210 may decrease moving toward an aft end 214 of the shell 210. A height 222 of the shell 210 may also decrease moving toward the aft end 214 of the shell 210. When the radome 200 is in the closed position, as shown in FIG. 1, the radar system 120 may be positioned within the internal volume 212 of the shell 210.

The radome 200 may have a support structure 230 coupled thereto. More particularly, the support structure 230 may include a base 232 that is coupled to the upper or top side 216 of the radome 200 (i.e., the side facing away from the ground 118). One or more arms (four are shown: 241-244) may extend from the base 232. One or more struts (two are shown: 245, 246) may serve as cross-beams between two or more of the arms 241, 242 to increase the stability and strength of the arms 241, 242. The support structure 230 is shown in a first, collapsed position in FIG. 2. In the collapsed position, the arms 241-244 are folded into the shell 210 of the radome 200 such that they are substantially parallel to the ground 118.

The top side 216 of the radome 200 may include one or more tracks (two are shown: 250) that extend(s) in an axial direction 260. As described in greater detail below, the tracks 250 may allow the radome 200 to move or slide in the axial direction 260 with respect to the body 110 of the aircraft 100. As also described in greater detail below, the base 232 of the support structure 230 may be positioned within the tracks 250 and configured to move or slide in the axial direction 260 with respect to the shell 210 of the radome 200.

Figure 3:
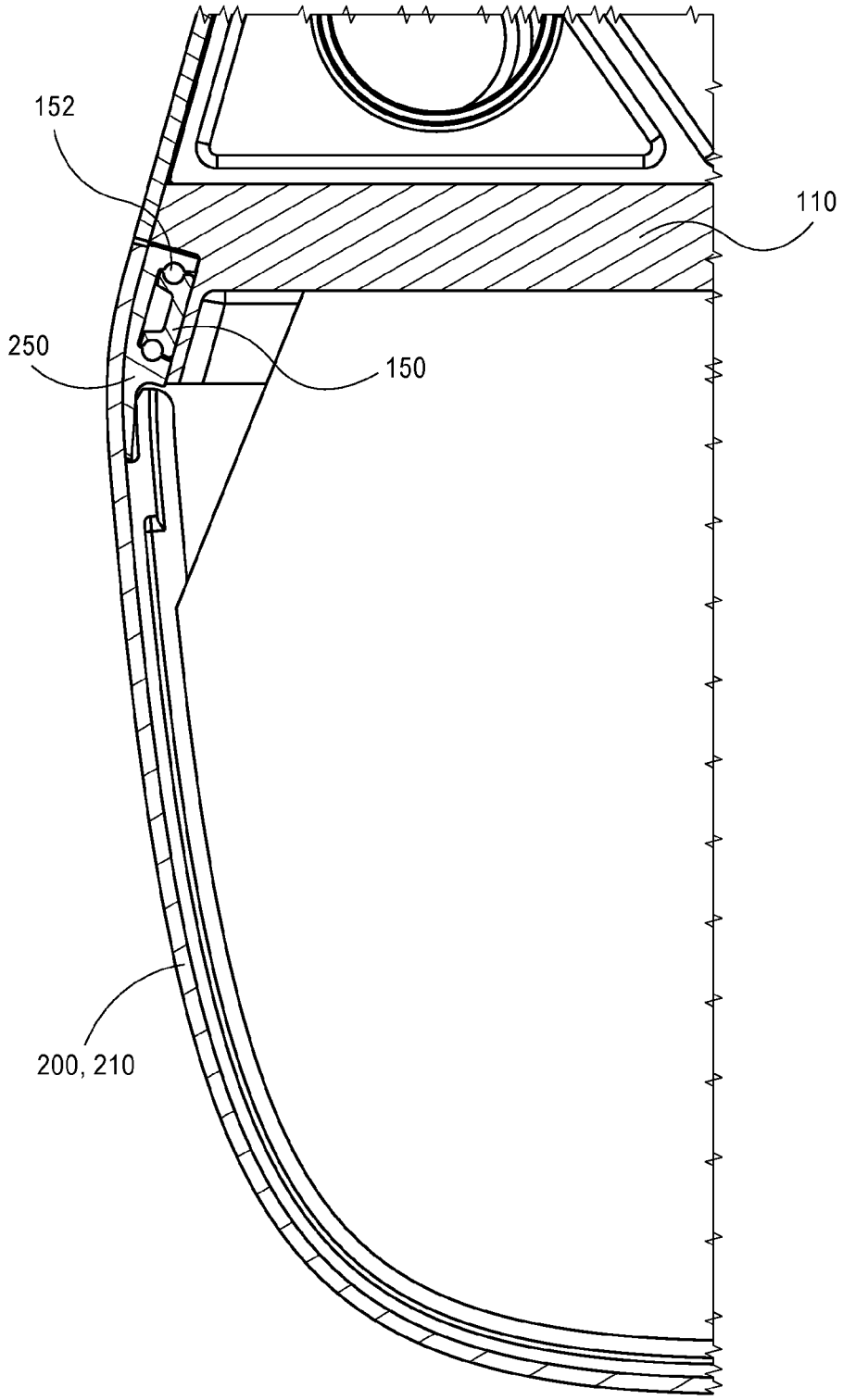
FIG. 3 is a cross-sectional view of a portion of the aircraft and the radome.

FIG. 3 is a cross-sectional view of a portion of the aircraft 100 and the radome 200. More particularly, FIG. 3 is a cross-sectional view of a portion of the aircraft 100 and the radome 200 as viewed from the tail of the aircraft 100 toward the nose of the aircraft 100. The track 250 of the radome 200 may be engaged with a corresponding track 150 of the aircraft 100. As shown, the track 250 of the radome 200 may be female, and the track 150 of the aircraft 100 may be male. Thus, the track 150 of the aircraft 100 may be positioned at least partially within the track 250 of the radome 200. In other embodiments, the track 250 of the radome 200 may be male, and the track 150 of the aircraft 100 may be female.

One or more bearings (e.g., roller balls or ball bearings) 152 may be positioned between the track 250 of the radome 200 and the track 150 of the aircraft 100. The bearings 152 may enable the track 250 of the radome 200 to more or slide axially with respect to the track 150 of the aircraft 100. In another embodiment, the track 250 of the radome 200 may include an axial groove or channel, and the track 150 of the aircraft 100 may include one or more wheels or balls that are able to rotate within the groove or channel to allow the radome 200 to move or slide with respect to the aircraft 100. In yet another embodiment, the track 250 of the radome 200 may include one or more wheels or balls, the track 150 of the aircraft 100 may include a groove or channel, and the wheels or balls may be able to rotate within the groove or channel to allow the radome 200 to move or slide with respect to the aircraft 100.

Figure 4:
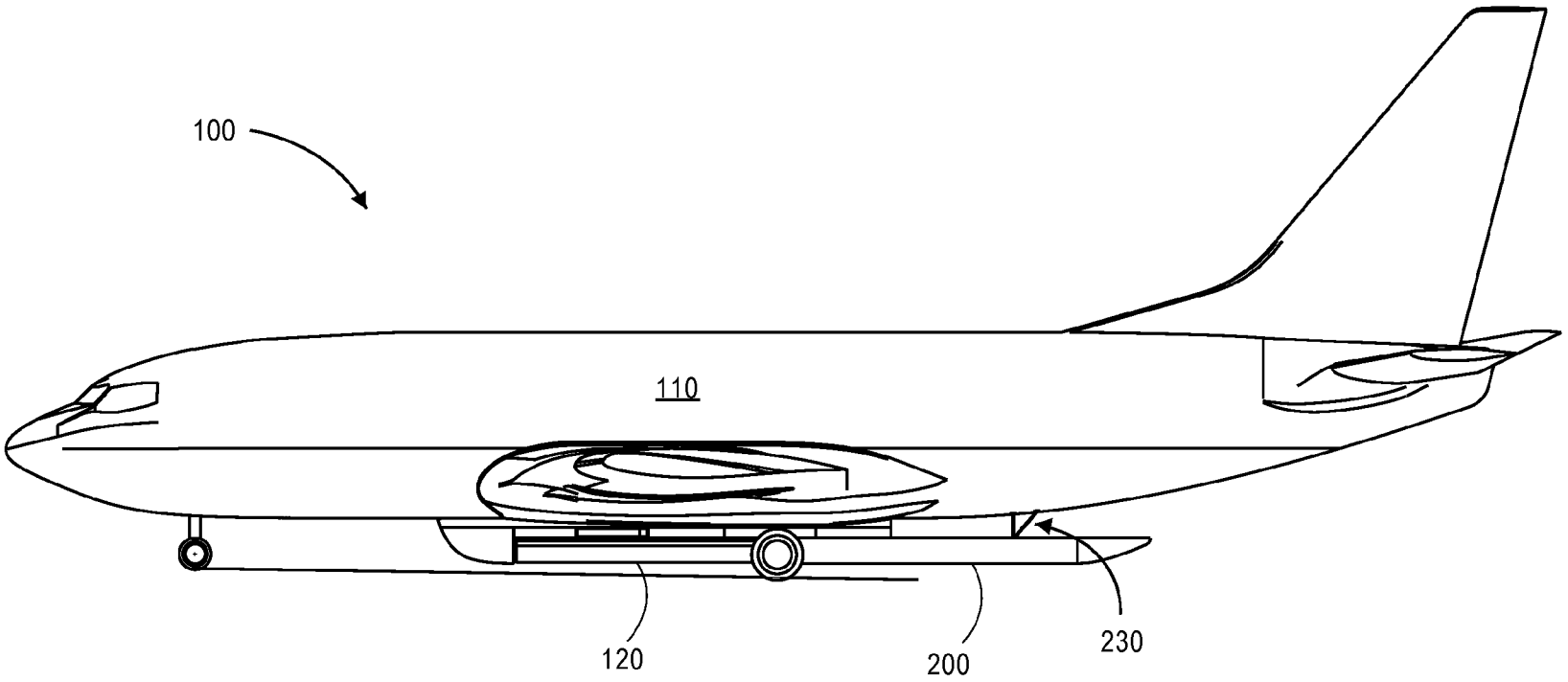
FIG. 4 is a side view of the aircraft showing the radome in an open position.
Figure 5:
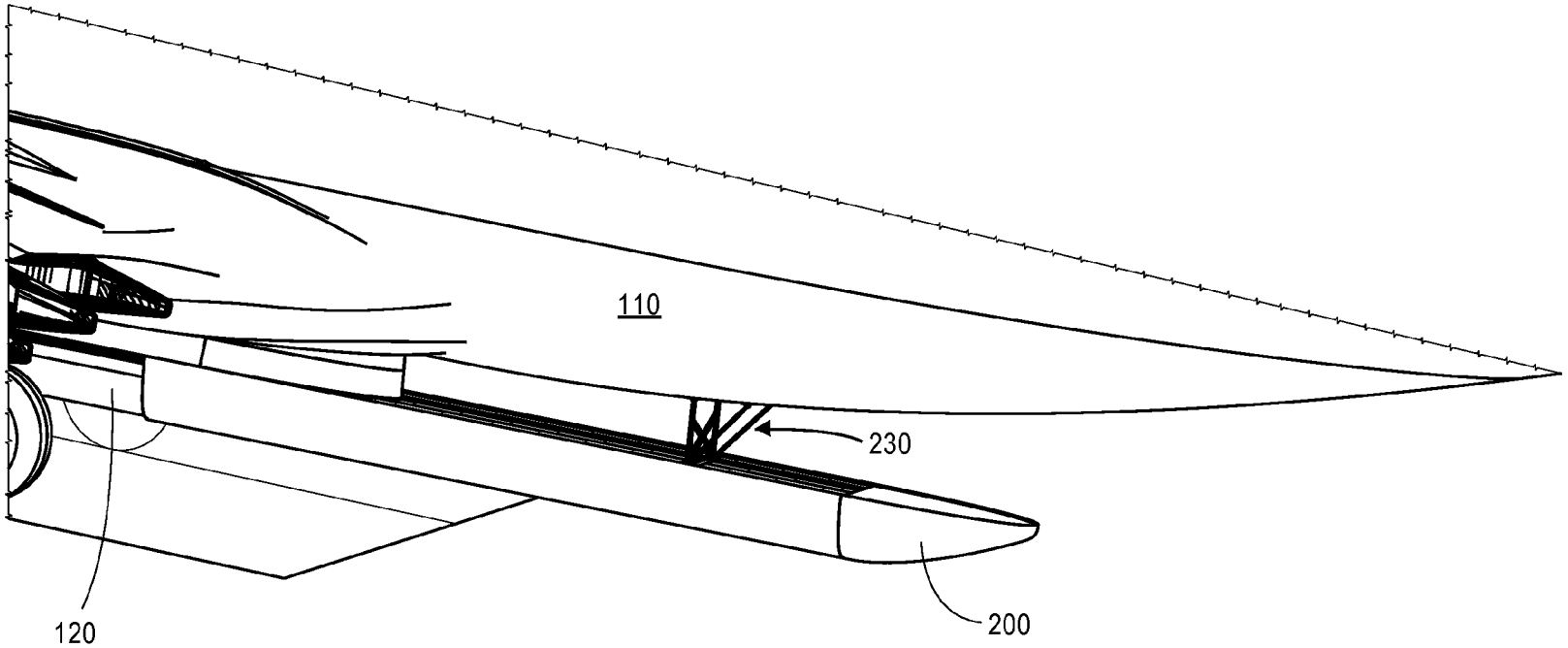
FIG. 5 is a perspective view of a portion of the aircraft showing the radome in the open position.

FIG. 4 is a side view of the aircraft 100 showing the radome 200 in a second, open position, and FIG. 5 is a perspective view of a portion of the aircraft 100 showing the radome 200 in the open position. Prior to performing maintenance on the radar system 120, the radome 200 may be actuated from the closed position (FIG. 1) to the open position (FIGS. 4 and 5). To move the radome 200 into the open position, an axial force may be exerted on the radome 200. The force may be generated by one or more people (e.g., pushing or pulling the radome 200) or by one or more motors. The force may cause the radome 200 to move axially with respect to the body 110 of the aircraft 100, by virtue of the sliding engagement of the tracks 150, 250, as discussed above. As shown, the radome 200 may move toward the aft of the aircraft 100 (i.e., toward the tail); however, in other embodiments, the radome 200 may move toward the front of the aircraft 100 (i.e., toward the nose).

When the radome 200 is in the open position, or partially between the closed and open positions, the support structure 230 may be actuated from the collapsed position (FIG. 2) to the expanded position (FIGS. 4 and 5). As will be appreciated, the support structure 230 may not be actuated into the expanded position when the radome 200 is in the closed position.

Figure 6:
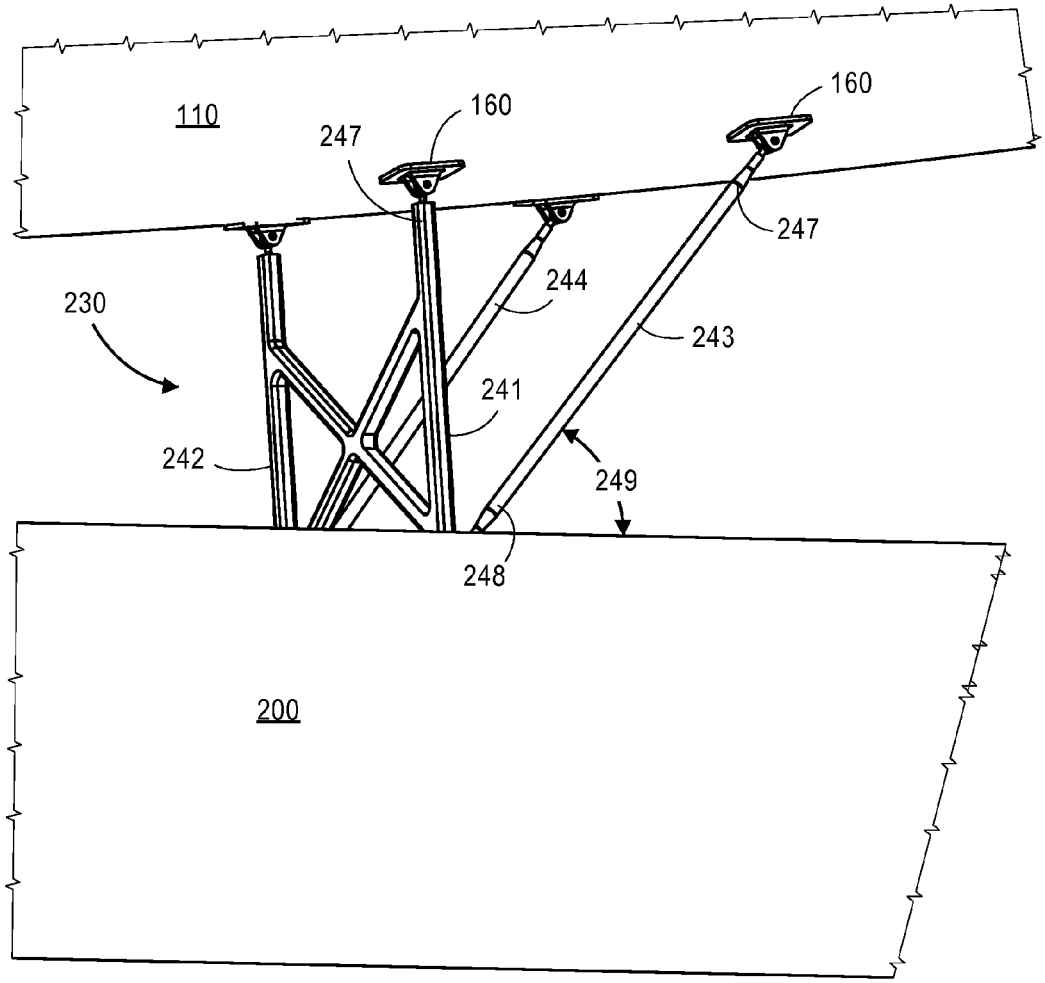
FIG. 6 is an enlarged view of the portion of the aircraft showing the radome in the open position.

FIG. 6 is an enlarged view of the portion of the aircraft 100 showing the radome 200 in the open position and the support structure 230 in the expanded position. One or more fittings (four are shown: 160) may be coupled to the outer surface of the body 110 of the aircraft 100. When the support structure 230 is actuated into the expanded position, the ends 247 of the arms 241-244 may be coupled to the fittings 160 to secure the support structure 230 in place with respect to the body 110 of the aircraft 100.

When the support structure 230 is in the expanded position, one or more of the arms (e.g., arms 241, 242) may be substantially perpendicular to the ground 118. As shown, the arms 241, 242 that include the struts 245, 246 may be substantially perpendicular to the ground 118. As such, these arms 241, 242 may support at least a portion of the weight of the radome 200.

When the support structure 230 is in the expanded position, one or more of the arms (e.g., arms 243, 244) may be oriented at an angle 249 with respect to the ground 118. More particularly, the ends 247 of the arms 243, 244 that are coupled to the fittings 160 may be positioned aft of the ends 248 of the arms 243, 244 that are coupled to the base 232. The arms 243, 244 may be substantially parallel to a plane that extends from the nose of the aircraft 100 to the tail of the aircraft 100. In another embodiment, the ends 247 of the arms 243, 244 that are coupled to the fittings 160 may be positioned laterally-outward from the base 232, so that the arms 243, 244 are not substantially parallel to the plane that extends from the nose of the aircraft 100 to the tail of the aircraft 100. The angle 249 may be from about 20 degrees to about 70 degrees or from about 30 degrees to about 60 degrees. The arms 243, 244 may keep the base 232 fixed relative to the body 110 of the aircraft 100. For example, without the arms 243, 244, support structure 230 may tend to rotate horizontally with respect to the body 110 of the aircraft 100 (e.g., during a cross-wind), or vertically with respect to the body 110 of the aircraft 100 (e.g., like a see-saw). Such rotation may also cause the tracks 150, 250 to bind, preventing movement of the support structure 230 with respect to the body 110.

The base 232 of the support structure 230 may be configured to move or slide within the track 250 of the radome 200, even when the support structure 230 is in the expanded position. This may allow the radome 200 to move or slide axially with respect to the body 110 of the aircraft 100 when the support structure 230 is in the expanded position and coupled to the fittings 160. In at least one embodiment, the radome 200 may be moved from the closed position to an intermediate position between the closed and open positions. The support structure 230 may then be actuated from the collapsed position to the expanded position and coupled to the fittings 160. The radome 200 may then be moved from the intermediate position to the open position as the base 232 of the support structure 230 moves or slides within the track 250 of the radome 200.

Once the radome 200 is in the open position, the radar system 120 may then be accessed by maintenance personnel. Once maintenance is complete, the radome 200 may be actuated from the open position back to the closed position. Thus, as may be seen, the radome 200 may be actuated between the open and closed positions while substantially maintaining the distance 116 between the radome 200 and the ground 118.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. It will be appreciated that structural components and/or processing stages can be added or existing structural components and/or processing stages can be removed or modified. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "about" indicates that the value listed may be somewhat altered, as long as the alteration does not result in nonconformance of the process or structure to the present teachings. Finally, "exemplary" indicates the description is used as an example, rather than implying that it is an ideal. The present disclosure provides specific implementations without being exhaustive, and other implementations of the present teachings may be apparent to those skilled in the art from consideration of the specification and practice of the disclosure herein. It is intended that the specification and examples be considered as exemplary only, with a true scope and spirit of the present teachings being indicated by the following claims.

The invention claimed is:

1. A radome, comprising:

a shell defining an internal volume;

a track coupled to the shell, wherein the track allows the shell to move axially between an open position and a closed position, wherein a distance between the shell and a ground remains substantially constant when the shell moves between the closed position and the open position; and a support structure coupled to the shell, wherein the support structure moves from a collapsed position to an expanded position.

2. The radome of claim 1, wherein the support structure is coupled to the track such that the support structure moves axially with respect to the shell.

3. The radome of claim 1, wherein the support structure is coupled to the track such that the support structure moves axially with respect to the shell when the support structure is in the expanded position.

4. The radome of claim 1, wherein the support structure comprises a first arm that is parallel to a ground when the support structure is in the collapsed position, and wherein the first arm is perpendicular to the ground when the support structure is in the expanded position.

5. The radome of claim 4, wherein the support structure further comprises a second arm that is parallel to the ground when the support structure is in the collapsed position, and wherein the second arm is oriented at an angle from 20 degrees to 70 degrees with respect to the ground when the support structure is in the expanded position.

6. The radome of claim 1, wherein the track coupled to the shell is configured to slidingly engage a corresponding track coupled to a body, and wherein the shell moves axially with respect to the body between the open position and the closed position.

7. The radome of claim 6, wherein a radar system is coupled to the body, wherein the shell allows access to the radar system when the shell is in the open position, and wherein the shell covers the radar system when the shell is in the closed position.

8. The radome of claim 7, wherein the support structure is not coupled to the body when the support structure is in the collapsed position, and wherein the support structure is configured to be coupled to the body when the support structure is in the expanded position.

9. The radome of claim 8, wherein the support structure moves with respect to the shell when the support structure is coupled to the body.

10. A radome, comprising:

a shell defining an internal volume;

a track coupled to the shell, wherein the track coupled to the shell is configured to slidingly engage a corresponding track coupled to a body, and wherein the track coupled to the shell is configured to move axially with respect to the track coupled to the body, thereby allowing the shell to move axially with respect to the body between an open position and a closed position; and a support structure coupled to the shell, wherein the support structure is configured to move from a collapsed position to an expanded position, and wherein the support structure is coupled to the track coupled to the shell such that the support structure is configured to move axially with respect to the shell.

11. The radome of claim 10, wherein the body comprises:

a wing;

an engine coupled to the wing; and a radar system coupled to a lower side of the body, wherein the shell covers the radar system when in the closed position and allows access to the radar system when in the open position, and wherein at least a portion of the radar system is positioned below a lowermost point of the engine.

12. The radome of claim 10, wherein the support structure moves with respect to the shell when the support structure is coupled to the body.

13. The radome of claim 10, wherein the support structure is not coupled to the body when the support structure is in the collapsed position, and wherein the support structure is configured to be coupled to the body when the support structure is in the expanded position.

14. The radome of claim 10, wherein the support structure is unable to move into the expanded position when the shell is in the closed position.

15. A method for accessing a radar system that is coupled to a bottom side of a body of an aircraft, comprising:

moving a shell axially toward an aft of the body from a closed position to an open position, wherein the shell covers the radar system when in the closed position, wherein the shell allows access to the radar system when in the open position, and wherein a distance between the shell and a ground remains constant when the shell moves between the closed position and the open position;

moving a support structure that is coupled to the shell from a collapsed position to an expanded position; and coupling the support structure to the body when the support structure is in the expanded position.

16. The method of claim 15, further comprising moving the support structure axially with respect to the shell when the support structure is in the expanded position.

17. The method of claim 16, further comprising moving the support structure axially with respect to the shell when the support structure is coupled to the body.

18. The method of claim 15, further comprising moving the support structure from the collapsed position to the expanded position when the shell is between the closed position and the open position.

* * * * *